US007703523B2

(12) United States Patent
Wardley

(10) Patent No.: US 7,703,523 B2
(45) Date of Patent: Apr. 27, 2010

(54) APPARATUS AND METHOD FOR USE IN A WELL BORE

(75) Inventor: Michael Wardley, Laurencekirk (GB)

(73) Assignee: Caledus Limited, Aberdeen (GB)

( * ) Notice: Subject to any disclaimer, the term of this patent is extended or adjusted under 35 U.S.C. 154(b) by 0 days.

(21) Appl. No.: 11/667,423

(22) PCT Filed: Nov. 14, 2005

(86) PCT No.: PCT/GB2005/004370

§ 371 (c)(1),
(2), (4) Date: Aug. 13, 2007

(87) PCT Pub. No.: WO2006/051321

PCT Pub. Date: May 18, 2006

(65) Prior Publication Data

US 2008/0017375 A1 Jan. 24, 2008

(30) Foreign Application Priority Data

Nov. 13, 2004 (GB) ..... 0425098.1

(51) Int. Cl.
*E21B 33/00* (2006.01)
*E21B 33/08* (2006.01)

(52) U.S. Cl. ..... 166/285; 166/177.3; 166/318

(58) Field of Classification Search ..... 166/285, 166/177.3, 318, 332.3
See application file for complete search history.

(56) References Cited

U.S. PATENT DOCUMENTS

| | | | | | |
|---|---|---|---|---|---|
| 3,054,415 | A * | 9/1962 | Baker et al. | ..... | 137/68.16 |
| 3,730,267 | A * | 5/1973 | Scott | ..... | 166/335 |
| 3,887,010 | A * | 6/1975 | Sizer et al. | ..... | 166/369 |
| 4,669,538 | A * | 6/1987 | Szarka | ..... | 166/120 |
| 5,738,171 | A * | 4/1998 | Szarka | ..... | 166/289 |
| 6,296,059 | B1 * | 10/2001 | Leeb et al. | ..... | 166/317 |
| 6,739,398 | B1 * | 5/2004 | Yokley et al. | ..... | 166/382 |
| 2003/0230405 | A1 * | 12/2003 | Allamon et al. | ..... | 166/193 |
| 2004/0020641 | A1 * | 2/2004 | Budde | ..... | 166/193 |

* cited by examiner

*Primary Examiner*—Jennifer H Gay
*Assistant Examiner*—Cathleen R Hutchins
(74) *Attorney, Agent, or Firm*—Sughrue Mion, PLLC

(57) ABSTRACT

Apparatus for use above and below a restriction in a well bore and a method of operation is described. The apparatus comprises an upper element, such as a wiper, operable in the well bore above the restriction and a lower element, which may be a lower wiper, operable in the well bore below the restriction. A drop ball sized to pass through the restriction is released from the upper element and thereby passes through the restriction to operate the lower element. In one embodiment, the apparatus is incorporated into a running tool, which may be used to hang liners by dimple forming.

42 Claims, 2 Drawing Sheets

APPARATUS AND METHOD FOR USE IN A WELL BORE

BACKGROUND OF THE INVENTION

The present invention relates to the operation of tools above and below restrictions in a well bore and in particular, though not exclusively, to a running tool with wiper plugs used to cement casing or liner in a well bore.

In operating tools in a well bore, it is common to have to work around restrictions in the diameter of a well bore. Such restrictions may be in the diameter of casing, liner, production tubing or deployment string. Restrictions may also exist in the through bore of the work string or deployment string depending on the space requirement of the tools mounted thereon. The restrictions may be a reduction in diameter of the bore, or a convoluted path in the bore. Thus there is a need to design tools which can operate effectively above and below such restrictions.

In the field of cementing in well bores, plugs are used to separate fluids pumped through the well bore. These plugs typically comprise an elongate body terminating in a rounded nose. A number of radial wiper blades are located on the body, behind the nose. In use, the plug is inserted into the well bore and the blades contact the wall of the well bore to create a seal between those fluids in front of the plug and those behind. The plug is then moved through the well bore by the pumping of fluid behind the plug.

On reaching a reduced diameter restriction in the well bore, the plug must firstly be sized so that its nose and body can pass through the restriction and further the blades must be sufficiently flexible to fold back and reduce the overall diameter of the plug. Yet further, the blades must be suitable for correct expansion to provide a seal when the plug exits the restriction into a portion of the well bore with a wider diameter again.

A disadvantage of these plugs is that, in making the blades sufficiently flexible to fold back, the plug is prone to deviate from the central axis as it passes through the well bore above the restriction. This deviation can cause loss of contact between the blades and the wall, thus losing the required sealing function. Further the deviation can cause the nose to strike any ledge at the top of the restriction which results in the plug being stuck in the well bore. Yet further the flexible blades make ineffective contact with the walls of the well bore below the restriction.

U.S. Pat. No. 6,698,513 overcomes one of these problems by providing a second wiper plug at the base of the restriction. The second wiper plug is advantageously sized for the well bore diameter below the restriction and initially retained in position by shear pins. In use, a smaller, first or upper, wiper plug travels through the restriction and seats in the second wiper plug. Pressure build up behind the first plug causes shearing of the pins and the release of the combined wiper assembly to be pumped further down the well bore. This apparatus, however, still has the disadvantage that the wiper plug which passes through the restriction must have flexible blades. The wiper plug is thus prone to jamming above the restriction and will provide less effective wiping of the walls above the restriction also.

It is an object of at least one embodiment of the present invention to provide apparatus for use above and below a restriction in a well bore which does not require the operational part above the restriction to pass through the restriction.

It is further object of at least one embodiment of the present invention to provide a running tool wherein independent wiper plugs operate above and below the tool without the upper wiper plug passing through the tool.

It is a yet further object of at least one embodiment of the present invention to provide a method of sequentially actuating elements within a well bore where the elements are located at either side of a restriction in the well bore.

SUMMARY OF THE INVENTION

According to a first aspect of the present invention there is provided apparatus for use above and below a restriction in a well bore, the apparatus comprising an upper element operable in the well bore above the restriction, a lower element operable in the well bore below the restriction and a drop ball sized to pass through the restriction, the apparatus comprising means for releasing the drop ball when the upper element is at the restriction such that the drop ball passes through the restriction and operates the lower element.

The upper element may be unable to pass through the restriction. Optionally, the upper element has a diameter greater than the diameter of the restriction.

The apparatus as may comprise retaining means for temporarily retaining the drop ball, the retaining means being located in the well bore and adapted to be actuated by the upper element to release the drop ball.

The lower element may have a diameter greater than the diameter of the restriction.

Preferably, the lower element includes receiving means for receiving the drop ball, thereby operating the lower element.

According to a second aspect of the invention there is provided apparatus for use above and below a restriction in a well bore, the apparatus comprising an upper element operable in the well bore above the restriction, a lower element operable in the well bore below the restriction and a drop ball sized to pass through the restriction, wherein each element has a diameter greater than the diameter of the restriction, the upper element including a retaining means for temporarily retaining the drop ball, the lower element including receiving means for receiving the drop ball, and wherein the drop ball is released from the retaining means when the upper element is at the restriction and thereby passes through the restriction to be received in the receiving means and operate the lower element.

The upper and lower elements can both be designed for purpose without having to adapt the upper element to pass through the restriction.

It will be appreciated that while the term drop ball has been used, this represents any shaped projectile which can pass through the restriction. Such projectiles may be balls, plugs, bombs darts or the like.

Preferably the upper element is a tool for use in the well bore. More preferably the upper element is a wiper such as a wiper dart or displacement wiper as is known in the art. Preferably also the upper element includes a bore through which fluid can pass to communicate with the well bore. Preferably the retaining means is located at an end of the bore. Thus, when the drop ball is in the retaining means, the passage of fluid through the bore is blocked. In this way fluid pressure in the well bore can be used to cause operation of the upper element.

Preferably the retaining means is a ball seat. Preferably the ball seat is arranged to temporarily seat the drop ball until sufficient fluid pressure builds up behind the drop ball for the drop ball to be forced through the seat. The seat may be expandable, frangible, comprise a collet/sleeve arrangement or the like for temporarily retaining the drop ball but which release the drop ball when sufficient fluid pressure builds up behind the drop ball. The retaining means may include a rupture disc. The rupture disc prevents the passage of any fluids through the retaining means until sufficient pressure is applied by the drop ball.

Alternatively the retaining means may be weight set to release the drop ball. In this arrangement a portion of the retaining means would land on a surface at the top of the restriction and the landing force of the upper element would cause a release to operate and allow the drop ball to pass through the retaining means.

Preferably the lower element is a tool for use in the well bore. More preferably the lower element is a wiper such as a wiper dart or displacement wiper as is known in the art. Preferably also the lower element includes a bore through which fluid can pass to communicate with the well bore. Preferably the retaining means is located at an end of the bore. Thus, when the drop ball locates in the retaining means, the passage of fluid through the bore is blocked. In this way fluid pressure in the well bore can be used to cause operation of the lower element.

Preferably the receiving means is a ball seat. Preferably the seat is arranged to permanently retain the drop ball.

In an alternative embodiment the ball seat may be arranged to temporarily seat the drop ball until sufficient fluid pressure builds up behind the drop ball for the drop ball to be forced through the seat. This alternative embodiment would allow a plurality of elements to be operated through a well bore with multiple restrictions or provide for circulation of fluid through the well. The seat may be expandable, frangible, comprise a collet/sleeve arrangement or the like for temporarily retaining the drop ball but which release the drop ball when sufficient fluid pressure builds up behind the drop ball. The retaining means may include a rupture disc. The rupture disc prevents the passage of any fluids through the retaining means until sufficient pressure is applied by the drop ball.

Alternatively the receiving means may be weight set to release the drop ball. In this arrangement a portion of the receiving means would land on a surface at the top of the restriction and the weight of the upper element would cause a release to operate and allow the drop ball to pass through the receiving means and on through a further restriction.

The drop ball may comprise a central portion of a relatively hard material such as steel, with an outer coating of a compressible material such as rubber or plastic. Thus the fluids behind the ball are kept separate from those in front, positive displacement of fluid is achieved and the walls of the restriction may also be wiped on passage of the drop ball.

According to a third aspect of the invention, there is provided a downhole tool for use in a well bore, the tool comprising a body having a first bore to provide fluid communication from an upper end to a lower end of the body, an upper element, a lower element, a drop ball sized to pass through the first bore, and means for releasing the drop ball upon the sufficient build up of fluid pressure at the upper element such that the drop ball passes through the first bore to operate the lower element.

According to a fourth aspect of the present invention there is provided a downhole tool for use in a well bore, the tool comprising a body having a first bore to provide fluid communication from an upper end to a lower end of the body, an upper element, a lower element, and a drop ball sized to pass through the first bore, wherein each element has a diameter greater than the diameter of the first bore, the upper element including a retaining means for temporarily retaining the drop ball, the lower element including receiving means for receiving the drop ball, and wherein the drop ball is released from the retaining means by the sufficient build up of fluid pressure at the upper element and thereby passes through the first bore to be received in the receiving means and operate the lower element.

Preferably the upper and lower elements together with the drop ball are according to the first aspect.

In an alternative embodiment, the lower element comprises the ball seat. More preferably the lower element is located in the first bore. In this way, the second operation of the tool is to block the restricted bore. This controls the passage of fluid through the tool. Following the build up of sufficient fluid pressure on the lower ball seat, the drop ball can be released and fluid can again pass through the restriction.

The body includes one or more bypass bores. Each bypass bore may provide a fluid path around the receiving and/or retaining means. The bypass bores provide a fluid returns path when the tool is run in a well bore.

Preferably also, the body comprises one or more operating elements on an outer surface thereof. As the drop ball requires only a narrow bore to pass through the body, there is space on the body to incorporate these operating elements. The bore may thus be off-centre, or follow a convoluted path.

Preferably the tool is a running tool, wherein the upper and lower elements are cement wipers and the operating elements include slips and dimple formers, as are known in the art.

According to a fifth aspect of the present invention there is provided a method of actuating elements within a well bore, the method comprising the steps of:

(a) locating a lower element below a restriction in the well bore;
(b) locating an upper element and a drop ball in the well bore above the restriction;
(c) moving the upper element toward the restriction by fluid pressure;
(d) on the upper element reaching the restriction, building up fluid pressure sufficient to cause the drop ball to be released;
(e) passing the drop ball through the restriction;
(f) operating the lower element using the drop ball.

The method preferably includes the additional steps of locating the drop ball in the upper element and releasing the drop ball from the upper element upon sufficient build-up of fluid pressure.

The method may include the additional steps of receiving the drop ball in the lower element and thereby operating the lower element.

According to a sixth aspect of the present invention there is provided a method of actuating elements within a well bore, the method comprising the steps:

(a) locating a lower element below a restriction in the well bore, the lower element having a diameter greater than that of the restriction;
(b) locating an upper element in the well bore above the restriction, the upper element including a drop ball located therein and the upper element having a diameter greater than that of the restriction;
(c) moving the upper element toward the restriction by fluid pressure on the drop ball and thereby operating the upper element;
(d) on the upper element reaching the restriction, building up fluid pressure behind the drop ball sufficient to cause the drop ball to be released from the upper element;
(e) passing the drop ball through the restriction;
(f) locating the drop ball in the lower element and thereby operating the lower element in the well bore.

The method may include the step of running a tool including a restriction into the well bore.

Advantageously the method may further include the step of operating one or more additional elements from the tool.

Steps (c) to (f) may be repeated to operate a series of elements between restrictions through a well bore.

The method may include the step of wiping the well bore with the upper and/or lower element.

BRIEF DESCRIPTION OF THE DRAWINGS

An embodiment of the present invention will now be described, by way of example, with reference to the accompanying figures in which.

DESCRIPTION OF THE PREFERRED EMBODIMENT

Figure 1:
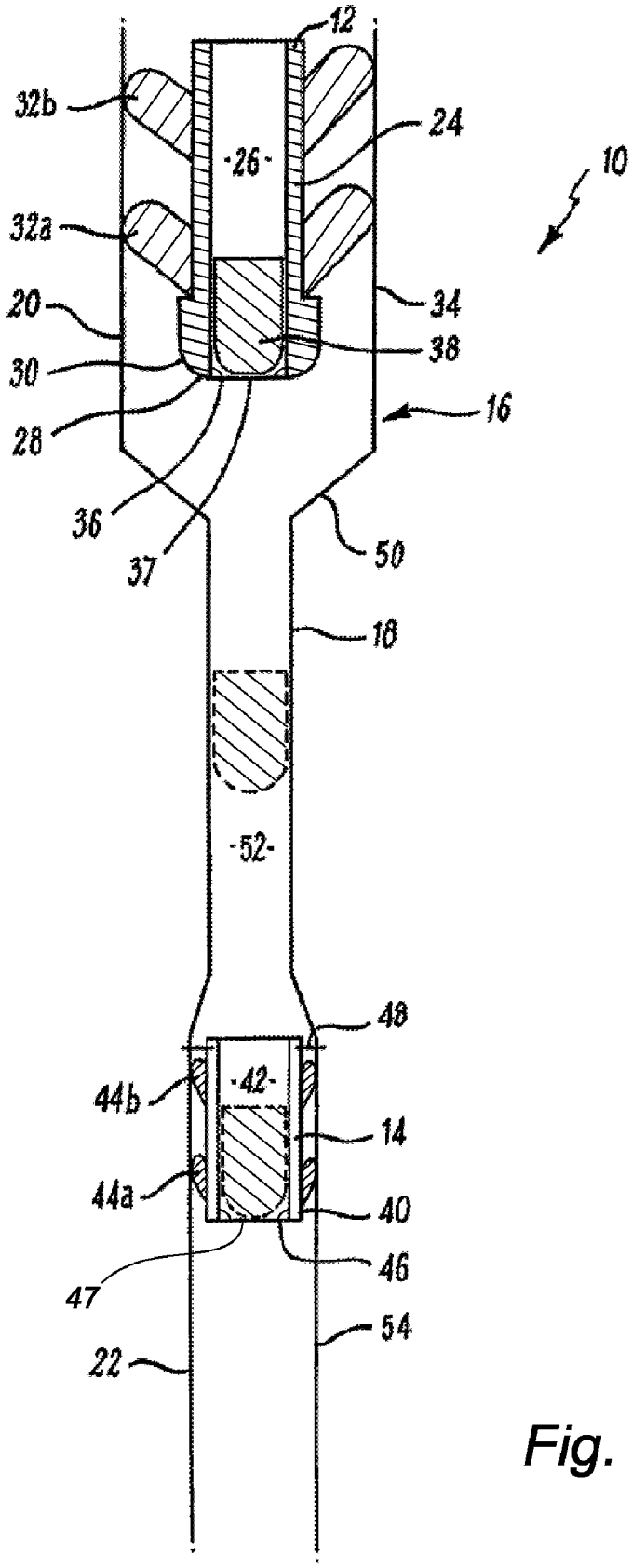
FIG. 1 is a schematic illustration of apparatus according to an embodiment of the present invention.
Figure 2A:
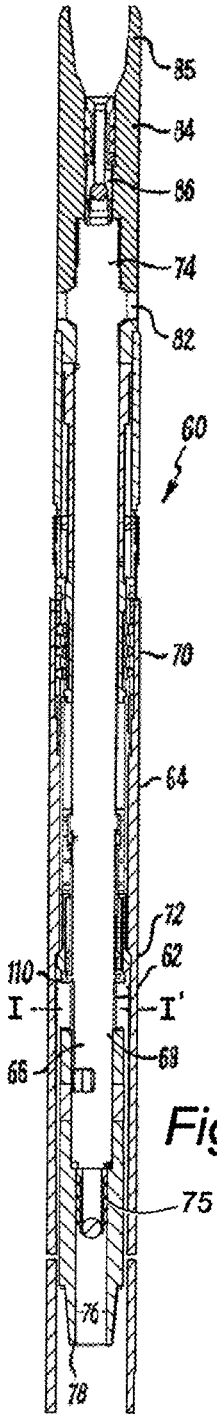
FIG. 2 is a cross-sectional view through a running tool in accordance with a further embodiment of the present invention where FIG. 2(*a*) shows the full tool, FIG. 2(*b*) is an exploded view of the upper part of the tool, FIG. 2(*c*) is an exploded view of the lower part of the tool and FIG. 2(*d*) is a sectional view through the line A-A' on FIG. 2(*a*).
Figure 2B:
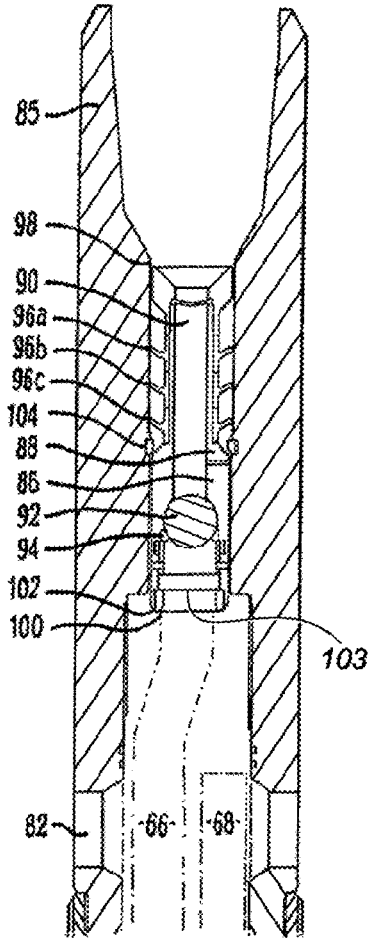
Figure 2C:
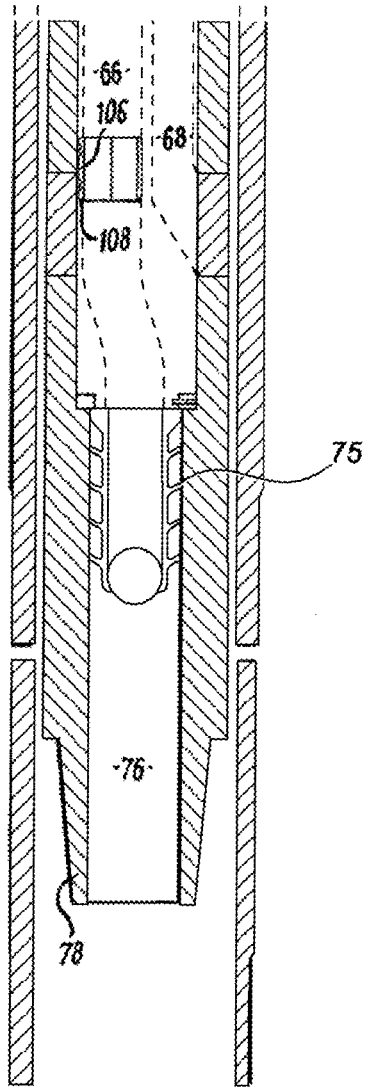
Figure 2D:
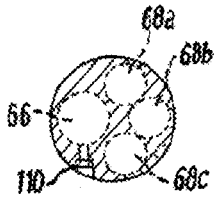

Reference is initially made to FIG. 1 of the drawings which illustrates apparatus, generally indicated by reference numeral 10, according to an embodiment of the present invention. Apparatus 10 comprises an upper element being an upper wiper plug 12 and a lower element, being a lower wiper plug 14. The well bore 16 has a narrowed bore or restriction 18 lying between upper 20 and lower 22 portions with diameter greater than that of the restriction 18. The upper wiper plug 12 is sized to pass through the upper portion 20 and the lower wiper plug 14 is initially located in the lower portion 22 and sized to pass therethrough.

The restriction 18 may be a result of the insertion of liner, production tubing or other narrow bore tubing used in the drilling and/or completion of a well bore. Alternatively the restriction 18 any exist in the through bore of the deployment string, work string or even a running tool, depending on the space requirement of the tools mounted thereon. The restriction may be concentric with or eccentric with the well bore 16, and may follow a substantially straight path or a convoluted path.

Upper wiper plug 12 has an elongate body 24 having a bore 26 running axially therethrough. At its lower end 28, is a rounded nose 30 to provide streamlined travel through the bore 16. Arranged on the body 24 and extending radially backwards therefrom are two wiper blades 32*a,b*. Blades 32*a,b* are made of a sufficiently stiff material to scrape and wipe the wall 34 of the upper portion 20. Preferably the blades 32*a,b* are of a rubber, elastomeric or rubber-like material to create a seal against the wall 34 and between fluids behind the plug 12 and those in front. Such rubber-like materials may be plastics, polymeric materials such as Teflon® or similar, displaying rubber-like characteristics. As can be seen from FIG. 1, a substantial part of the diameter of the plug 12 is made up of the body 24. In this way the blades 32 can be made so that they have minimal flex and consequently the plug 12 will travel centrally through the upper portion 20.

Within the bore 26, at the lower end 28 there is a ball seat 36. Seat 36 is of a yieldable material such as aluminum. Bore 26 and the seat 36 are sized for a drop ball 38 to pass unrestricted through the bore 26 and be halted at the seat 36. A rupture disc 37 is mounted in combination with the seat 36 such that the rupture disc 37 prevents the passage of fluid through the bore 26. The rupture disc 37 can thus be set to rupture at a selected pressure prior to the ball reaching he seat 36. In this way the seat 36 can be manufactured to create minimal resistance to the balls passage therethrough.

Lower wiper plug 14 also has an elongate body 40 with a bore 42 running axially therethrough. Bore 42 is of a similar diameter to bore 18. In this way, the drop ball 38 can pass through the bore 42. Blades 44*a,* 44*b* of similar design and stiffness to the blades 32 are located on the body 40. While the illustration shows the blades 44 of the lower plug 14 being narrower than the blades 32 of the upper plug 12, it will be appreciated that the blades 32, 44 will be sized to suit the diameter of the bore 16 at the respective portions 20, 22. Within the bore 42 there is a ball seat 46. Ball seat 46 halts the passage of a drop ball 38 passing through the bore 42.

In use, the lower plug 14 is located in the well bore 16 immediately below the restriction 18. In the embodiment shown the lower plug 14 is held in position by shear pins 48. Fluids can be passed through the bore 16 and the plug 14 will not restrict the flow since the bore 42 is sized as for the bore 52 of the restriction 18. When a second fluid needs to be passed through the bore 16, the upper plug 12 is inserted between the two fluids. A drop ball 38 is located in the bore 26 and rests against the seat 36. Pumping of the second fluid will force the upper plug 12, with the ball 38, through the upper portion 20. As it travels, the plug 12 will keep the fluids separated and wipe the wall 34 of the upper portion 20.

When the upper plug 12 reaches the restriction 18, the nose 28 will contact a ledge 50 at the point where the restriction 18 begins. Since the plug 12 has a wide body 24 are narrower blades 32, the plug will come to rest in a vertical orientation. The bore 26 will be in line with the bore 52 of the restriction 18. With the plug 12 held stationary at the ledge 50, fluid pressure from the second fluid will act on the ball 38. The pressure will build up until there is sufficient pressure for the ball 38 to rupture the disc 37 and thereafter to be forced through the seat 36. At this point, the seat 38 will yield and eject the ball into the bore 52 of the restriction 18. The landing force of the plug 12 against the ledge 50 can also cause the disc 37 to rupture and/or the ball 38 to pass through the seat 36.

Under continued fluid pressure, the drop ball 38 passes through the bore 52. Advantageously the bore 52 is of similar dimensions to the ball 38 so that the ball can pass unheeded but still retain separation of the fluids.

On release from the bore 52, the ball will pass into the bore 42 of the lower plug 14. The ball will then be halted at the ball seat 46. Fluid pressure from the second fluid again builds up behind the ball until it is sufficient to shear the shear pins 48. This releases the lower plug 14, which then travels through the lower portion 22, maintaining the separation of the fluids and wiping the wall 54 of the lower portion 22.

With the ball 38 on the seat 46 pressure can be built up in the well bore above the plug to set/operate other tools. Alternatively if circulation is required and fluid is to be passed through the lower plug 14 it can be stopped in the well bore 16, by a further ledge, and sufficient pressure used to force the ball through the ball seat 46.

Effectively the drop ball has caused the sequential operation of tools on either side of a restriction in a well bore where the body of each of the tools has a greater inner diameter than the restriction.

Reference is now made to FIG. 2 of the drawings which illustrates a running tool, generally indicated by reference numeral 60, according to a further embodiment of the present invention.

As is known in the art, a running tool is used for inserting liners or other tubulars in a cased well bore. As such the tool requires to have a number of operational features which necessitate the mounting of components on the outer surface 62 of the tool. These components may comprise expanders or dimple formers 70 used to hang the liner 64 from the existing casing. Grips, here shown as collets 72, for holding the liner 64 to the tool 60 during run in are also on the outer surface. It will be appreciated that the grips could be running threads or other connection means known to those skilled in the art. Additionally, for SlimWELL™ applications and other close tolerance casing operations, a flow path needs to be created from the base of the tool to the inside of the liner above the tool. In the embodiment shown this is provided by three off-axis conduits 68 arranged in parallel within the body 74 of the tool. These carry fluids from the lower bore 76 at the base 78 of the tool 60 to above the liner 64. The fluid is passed out from the conduits 68 via side ports 82 at the top 84 of the tool 60.

In order to provide sufficient space for these components within the liner and casing 64, the bore 66 of the tool must be restricted in diameter. It may also be an off-centre eccentric arrangement providing a convoluted path through the tool.

At the top 84 of the tool 60 is located a box section 85 as is known in the art for connecting the tool 60 to a work string (not shown). Shown at the top of the tool is a wiper plug 86, best seen with the aid of FIG. 2(*b*). Wiper plug 86 comprises an elongate body 88 having a bore 90 therethrough. Located in the bore 90 is a drop ball 92 shown located in a ball seat 94. Ball seat 94 is made of a yieldable material such as aluminum. The ball 92 can be forced through the seat 94 under sufficient fluid pressure in the bore 90 above the ball seat 94. Wiper plug 86 further includes three rows of wiper blades 96 arranged circumferentially on the body 88. Blades 96 are of a sufficiently stiff material to provide a sealing contact with the bore 98 through the top 85 of the tool and the bore of the work string above.

The passage of the wiper plug 86 is limited by the ledge 100 located at the top of the restricted bore 66. The lower end 102 of the plug 86 will contact the ledge 100 and be prevented from travelling forwards. The plug 86 is also prevented from travelling back up the work string by virtue of the sprung pins 104 located in the bore 98.

At the lower end 78 of the tool 60 is located a further ball seat 106. Seat 106 constitutes the lower operating element of the tool 60. The ball seat 106 is located within the bore 66, at an end 108 thereof. Ball seat 106 is also of yieldable material as for the ball seat 94 of the wiper plug 86. A ball located in the seat 106 can be forced through the seat 106 under sufficient fluid pressure in the bore 66 above the ball seat 106. With a ball in the ball seat 1061, fluid flow through the bore 66 is prevented and the increased pressure in the bore 66 causes release of the collets 72 and consequently the tool 60 from the liner 64.

In use, the liner 64 is located on the tool 60 and held via the collets 72. The tool 60 is run into casing and located at an end thereof. During run in, fluids can pass up the bypass conduits 68 and the narrow bore 66. When fluids, such as cement, are passed through the work string the wiper plug 86 is inserted between the fluids at the surface of the well. Ball 92 is located in the wiper plug 86 when it is deployed. Fluid pressure behind the ball 92 causes movement of the plug 86 through the bore of the work string. In this movement, the blades 96 cause the fluids to remain separated while they wipe the wall of the bore free of contaminants. The body 88 is large and the blades 96 are of narrow diameter so as to improve stability of the plug 86 as it passes through the bore 98.

When the end 102 of the plug 96 reaches the ledge 100 at the top of the narrow bore 66, the plug 86 is stopped. Pressure builds up behind the ball 92 until it is sufficient to force the ball 92 through the yieldable ball seat 94. The ball 92 then travels through the narrow bore 66, following the eccentric path. The ball 92 is sized to travel freely, but provides sufficient separation of the fluids through the narrow bore 66.

The ball 92 comes to rest in the ball seat 106 at the bottom 108 of the bore 66. While at rest, fluid pressure will build up behind the ball 92 in the bore 66. This pressure will be sufficient to force the collet 72 inwards and thus release the tool 60 from the liner 64. Alternatively, or additionally, the pressure increase can be used to operate the dimple formers 74 to hang the liner 64 to the existing casing.

The tool 60 including the ball 92 will pass through the well bore until it reaches a further restriction. At this point, if the seat 106 is firm, it will allow a user to pressure up behind the tool 60 to operate other tools in the well. Alternatively, or additionally, the seat 106 can be selected to yield at a pressure so that the ball can be selectively displaced from the tool 60 if a circulation path through the tool 60 is required.

It will be appreciated that while a ball seat has been described as the lower element, a wiper plug or other moveable element could be located at the base of the running tool.

The embodiments described include a drop ball located and retained in the upper element and/or received by the lower element. However, in alternative embodiments the drop ball may be temporarily retained in the well bore above the restriction, and released by contact with or actuation by the upper element. Similarly, the lower element may be retained below the restriction, and may be operated or released by contact with or actuation by the drop ball.

It will further be appreciated that while the terms upper, lower, top and bottom have been used through out this description, these are only relative and the invention would find equal application in deviated or horizontal well bores.

The principal advantage of the present invention is that it provides apparatus for use above and below a restriction in a well bore which does not require the operational part above the restriction to pass through the restriction. Thus this part can be made fit for purpose.

A further advantage of at least one embodiment of the present invention is that it provides a running tool wherein independent wiper plugs can operate above and below the tool without the upper wiper plug passing through the tool.

It will be understood by those skilled in the art that modifications may be made to the invention herein described without departing from the scope thereof. For example, the upper and lower elements can be any downhole component which includes a receiving and a retaining means respectively.

The invention claimed is:

1. Apparatus for use above and below a restriction in a well bore, the apparatus comprising an upper element operable in the well bore above the restriction, a lower element operable in the well bore below the restriction and a drop ball sized to pass through the restriction under fluid pressure while keeping fluids behind the drop ball separate from fluids in front, the apparatus comprising means for releasing the drop ball when the upper element is at the restriction such that the drop ball passes through the restriction, positively displacing fluid, and then operates the lower element.

2. Apparatus as claimed in claim 1 wherein the upper element is unable to pass through the restriction.

3. Apparatus as claimed in claim 2 wherein the upper element has a diameter greater than the diameter of the restriction.

4. Apparatus as claimed in claim 1 wherein the upper element is a tool for use in the well bore.

5. Apparatus as claimed in claim 4 wherein the upper element is a wiper.

6. Apparatus as claimed in claim 1 comprising retaining means for temporarily retaining the drop ball, the retaining means being located in the well bore and adapted to be actuated by the upper element to release the drop ball.

7. Apparatus as claimed in claim 1 wherein the upper element includes a retaining means for temporarily retaining the drop ball.

8. Apparatus as claimed in claim 1 wherein the upper element includes an inner bore through which fluid can pass to communicate with the well bore.

9. Apparatus as claimed in claim 8 wherein the retaining means is located at an end of the inner bore.

10. Apparatus as claimed in claim 9 arranged such that when the drop ball is in the retaining means, the passage of fluid through the inner bore is blocked.

11. Apparatus as claimed in claim 6 wherein the retaining means is a ball seat.

12. Apparatus as claimed in claim 11 wherein the retaining means further includes a rupture disc.

13. Apparatus as claimed in claim 6 wherein the retaining means is weight set to release the drop ball.

14. Apparatus as claimed in claim 1 wherein the lower element is a tool for use in the well bore.

15. Apparatus as claimed in claim 1 wherein the lower element has a diameter greater than the diameter of the restriction.

16. Apparatus as claimed in claim 14 wherein the lower element is a wiper.

17. Apparatus as claimed in claim 1 wherein the lower element includes an internal bore through which fluid can pass to communicate with the well bore.

18. Apparatus as claimed in claim 17 wherein the lower element includes receiving means for receiving the drop ball, thereby operating the lower element.

19. Apparatus as claimed in claim 18 wherein the receiving means is located at an end of the internal bore.

20. Apparatus as claimed in claim 19, arranged such that when the drop ball locates in the receiving means, passage of fluid through the internal bore is blocked.

21. Apparatus as claimed in claim 18 wherein the receiving means is a ball seat.

22. Apparatus as claimed in claim 21 wherein the ball seat is arranged to permanently retain the drop ball.

23. Apparatus as claimed in claim 21 wherein the ball seat is arranged to temporarily seat the drop ball until the drop ball is exposed to sufficient fluid pressure for the drop ball to be forced through the seat.

24. Apparatus as claimed in claim 23 wherein the receiving means includes a rupture disc.

25. Apparatus as claimed in claim 23 wherein the receiving means is weight set to release the drop ball.

26. Apparatus as claimed in claim 1 wherein the drop ball comprises a central portion of a relatively hard material, and an outer coating of a compressible material.

27. A downhole tool for use in a well bore, the tool comprising a body having a first bore to provide fluid communication from an upper end to a lower end of the body the first bore being a restriction in the tool, an upper element located above the restriction, a lower element located at the lower end of the restriction, a drop ball sized to pass through the first bore under fluid pressure while keeping fluids behind the drop ball separate from the fluids in front, and means for releasing the drop ball upon the sufficient build up of fluid pressure at the upper element such that the drop ball passes through the first bore, positively displacing fluid, and then operates the lower element.

28. The downhole tool as claimed in claim 27 wherein the lower element comprises a ball seat.

29. The downhole tool as claimed in claim 27 wherein the lower element is located in the first bore.

30. The downhole tool as claimed in claim 27 wherein the body includes one or more bypass bores.

31. The downhole tool as claimed in claim 30 wherein each bypass bore provides a fluid path around receiving means located at the lower end of the restriction.

32. The downhole tool as claimed in claim 27 wherein the body comprises one or more operating elements on an outer surface thereof.

33. The downhole tool as claimed in claim 27 wherein the first bore is selected from a group consisting of eccentric, off-centre, and follows a convoluted path.

34. The downhole tool as claimed in claim 32 wherein the tool is a running tool, wherein the upper and lower elements are wipers and the operating elements are selected from a group consisting of slips, expanders and dimple formers.

35. A method of actuating elements within a well bore, the method comprising the steps of:

a) locating a lower element below a restriction in the well bore;

b) locating an upper element and a drop ball in the well bore above the restriction;

c) moving the upper element toward the restriction by fluid pressure;

d) on the upper element reaching the restriction, building up fluid pressure sufficient to cause the drop ball to be released;

e) passing the drop ball through the restriction under fluid pressure while keeping fluids behind the drop ball separate from fluids in front;

f) operating the lower element using the drop ball.

36. The method as claimed in claim 35 comprising the additional steps of locating the drop ball in the upper element and releasing the drop ball from the upper element upon sufficient build-up of fluid pressure.

37. The method as claimed in claim 35 comprising the additional steps of receiving the drop ball in the lower element and thereby operating the lower element.

38. The method as claimed in claim 35 comprising the step of running a tool including a restriction into the well bore.

39. The method as claimed in claim 38 wherein the method includes the step of operating one or more additional elements from the tool.

40. The method as claimed in claim 35 wherein steps (c) to (f) are repeated to operate a series of elements between restrictions through a well bore.

41. The method as claimed in claim 35 including the step of wiping the well bore with the upper element.

42. The method as claimed in claim 35 including the step of wiping the well bore with the lower element.

* * * * *